United States Patent [19]

Foote et al.

[11] 4,254,870

[45] Mar. 10, 1981

[54] CUSHIONING FORM

[75] Inventors: Allan E. Foote, Naperville; Steven J. Benzschawel, St. Charles, both of Ill.

[73] Assignee: Container Corporation of America, Chicago, Ill.

[21] Appl. No.: 115,696

[22] Filed: Jan. 28, 1980

[51] Int. Cl.[3] ..... B65D 81/02; B65D 85/30

[52] U.S. Cl. ..... 206/524; 229/32; 229/27

[58] Field of Search ..... 229/30, 32, 27, 28 R, 229/43; 206/524

[56] References Cited

U.S. PATENT DOCUMENTS

| | | | |
|---|---|---|---|
| 1,847,694 | 3/1932 | Kondolf | 229/32 |
| 2,437,114 | 3/1948 | Moore | 229/43 |
| 2,452,952 | 11/1948 | Palmer | 229/43 |
| 2,470,984 | 5/1949 | Horning et al. | 229/43 |
| 2,828,061 | 3/1958 | Zerlin | 229/43 |
| 3,967,773 | 7/1976 | Kaufmann | 229/43 |

*Primary Examiner*—Joseph Man-Fu Moy

*Attorney, Agent, or Firm*—Richard W. Carpenter

[57] ABSTRACT

A paperboard form for holding cushioning material to protect a packaged article within an outer container.

4 Claims, 3 Drawing Figures

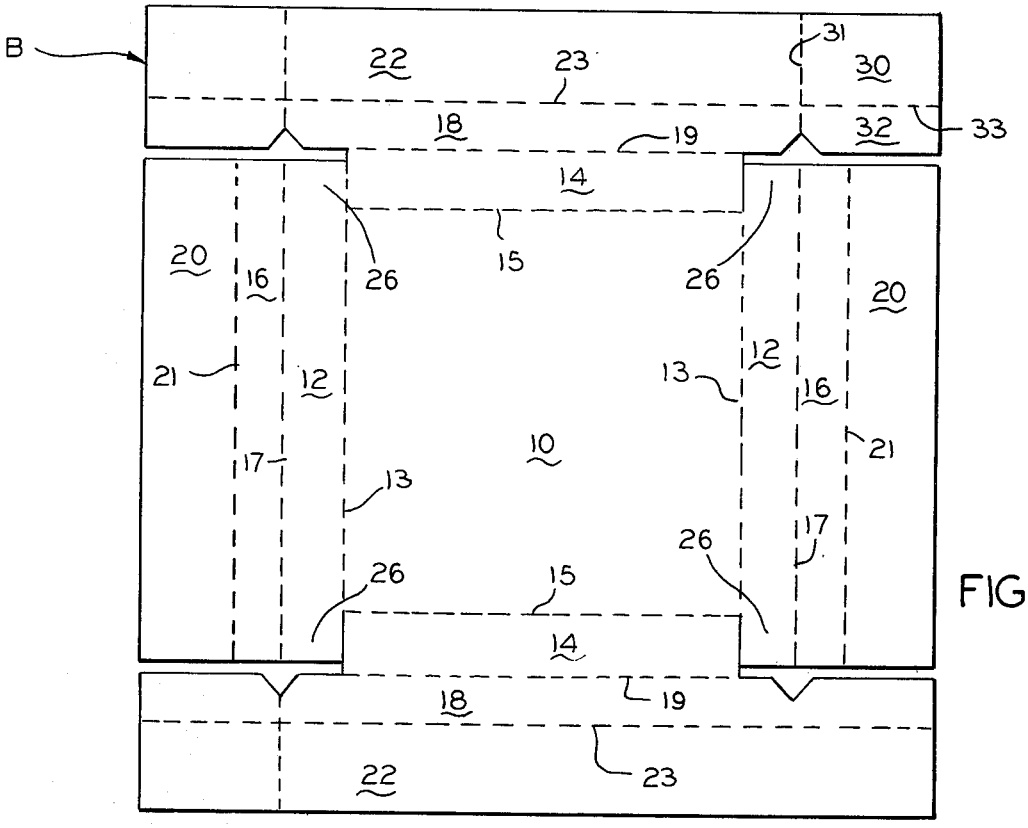
FIG.3
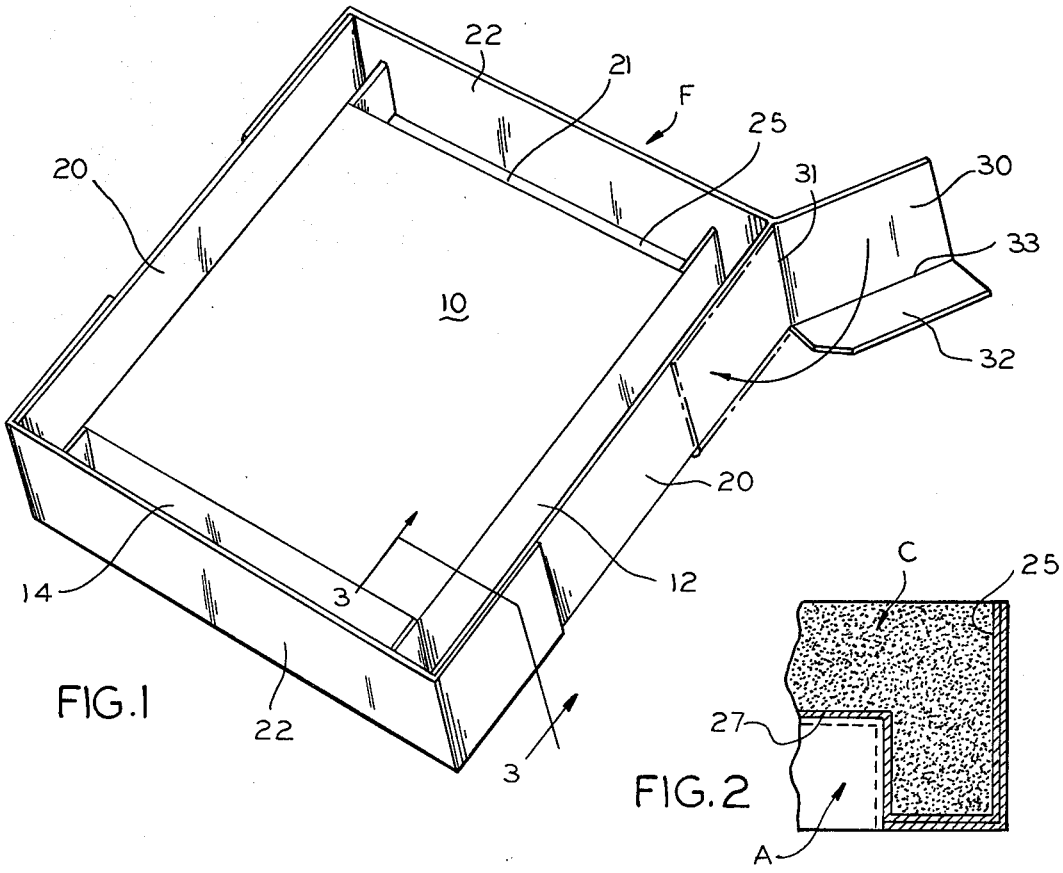
FIG.1
FIG.2

CUSHIONING FORM

SUMMARY OF THE INVENTION

This invention relates to a device for protecting and cushioning a packaged article within an outer shipping container.

The invention particularly relates to a form which may be used alone as a cushioning insert or which is adaptable for use in holding cushioning material, either loose particles or foam-in-place type plastic material.

A more specific object of the invention is the provision of a one piece paperboard tray type structure including a central horizontal panel and other panels forming a channel or trough around the central panel.

These and other objects of the invention will be apparent from an examination of the following description and drawings.

THE DRAWINGS

FIG. 1 is a fragmentary perspective view of a structure embodying features of the invention;

FIG. 2 is a partial vertical section taken on line 2—2 of FIG. 1; and FIG. 3 is a plan view of the blank from which the structure illustrated in the other views may be formed.

It will be understood that, for purposes of clarity, certain elements may have been intentionally omitted from certain views where they are believed to been illustrated to better advantage in other views.

THE DESCRIPTION

Referring now to the drawings for a better understanding of the invention, it will be seen that the cushioning form, indicated generally at F in FIG. 1, may be formed from a unitary blank B of foldable paperboard illustrated in FIG. 3.

The form is adapted to be used as a cushioning insert for protecting a packaged article A within an outer container (not shown). Although the form F may be used alone and will provide an air cell for protecting the packaged article, the form is particularly suited to hold or contain cushioning material such as foam-in-place plastic material C, as shown in FIG. 2, or loose particles plastic material.

Referring to FIGS. 1 and 3, it will be seen that the form F includes a horizontal central panel 10 having opposed pairs of vertical inner panels 12 and 14 foldably joined to and depending from opposed side edges thereof along fold lines 13 and 15, respectively. Opposed pairs of horizontal outer panels 16 and 18 are foldably joined along fold lines 17 and 19 to the lower edges of vertical inner panels 12 and 14, respectively, and extend outwardly therefrom. Foldably joined to the outer edges of panels 16 and 18 are opposed pairs of vertical outer panels 20 and 22 which are foldably joined at their lower edges on fold lines 21 and 23, respectively, and which extend upwardly above the plane of center panel 10. As best seen in FIG. 2, the vertical panels and the horizontal outer panels define with the center panel a cavity 25 which surrounds and is disposed above center panel 10 for receiving the cushioning material C. The vertical inner panels also define with center panel 10 an inner cavity 27 adapted to receive a portion of the packaged article A as shown in FIG. 2.

In order to provide additional strength for the corners of the structure, each of the vertical inner panels 12 are provided with opposed extensions 26 which project to the related vertical outer panels.

In order to complete the corner structure of the form there are provided at the ends of outer vertical panels 22 a pair of vertical corner flaps 30 foldably connected to related panels 22 on fold lines 31 and having foldably joined to their lower edges, along fold lines 33, horizontal corner flaps 32. Each corner vertical flap 30 and related corner horizontal flap 32 is adapted to be folded against the vertical outer panel and horizontal outer panel as illustrated in FIGS. 2 and 3. They may be secured to the related panels in any desired manner such as stitching, taping, or gluing. However, when cavity 25 is filled with foam-in-place type plastic material, the form is self locking and requires no securing means for the corners.

It will be understood that the present structure is a unique paperboard structure capable of holding foam-in-place plastic material to act as a cushioning device and replaces many pieces of packaging inserts used in comparable packages today, such as cut scored sheets, corner pads, and corner posts.

We claim:

1. A cushioning material holding form, formed of a unitary blank of foldable paperboard, or the like, for use in protecting a packaged article within an outer shipping container, comprising:

(a) a horizontal central panel;

(b) a plurality of vertical inner panels foldably joined to and depending from side edges of said central panel;

(c) a plurality of relatively narrow, horizontal outer panels foldably joined to and extending outwardly from lower edges of respective vertical inner panels;

(d) a plurality of vertical outer panels foldably joined to and upstanding from the outer edges of respective horizontal outer panels above the plane of said horizontal central panel;

(e) said vertical panels and said horizontal outer panels defining with said central panel a cavity disposed around and above said central panel for holding cushioning material; and (f) certain of said vertical inner panels having extensions projecting from ends thereof toward related vertical outer panels.

2. A form according to claim 1, and including vertical corner flaps foldably joined to end edges of certain of said vertical outer panels and operatively secured to adjacent vertical outer panels.

3. A form according to claim 2, and including horizontal flaps foldably joined to lower edges of said vertical corner flaps and disposed between end portions of adjacent horizontal outer panels.

4. A cushioning insert, formed of a unitary blank of foldable paperboard, or the like, for use in protecting a packaged article within an outer shipping container, comprising:

(a) a horizontal central panel;

(b) a plurality of vertical inner panels foldably joined to and depending from side edges of said central panel;

(c) a plurality of relatively narrow, horizontal outer panels foldably joined to and extending outwardly from lower edges of respective vertical inner panels;

(d) a plurality of vertical outer panels foldably joined to and upstanding from the outer edges of respective horizontal outer panels above the plane of said horizontal central panel;

(e) said vertical panels and said horizontal outer panels defining with said central panel a cavity disposed around and above said central panel for cushioning said packaged article; and (f) certain of said vertical inner panels having extensions projecting from ends thereof toward related vertical outer panels.

* * * * *